United States Patent [19]

Hefner, Jr.

[11] 4,276,156

[45] Jun. 30, 1981

[54] FROTH FLOTATION PROCESS USING CONDENSATES OF HYDROXYETHYLETHYLENEDIAMINES AS COLLECTORS FOR SILICEOUS MATERIAL

[75] Inventor: Robert E. Hefner, Jr., Lake Jackson, Tex.

[73] Assignee: The Dow Chemical Company, Midland, Mich.

[21] Appl. No.: 92,239

[22] Filed: Nov. 8, 1979

[51] Int. Cl.[3] ..... B03D 1/02

[52] U.S. Cl. ..... 209/166

[58] Field of Search ..... 209/166, 167; 252/61; 260/404

[56] References Cited

U.S. PATENT DOCUMENTS

| | | | |
|---|---|---|---|
| 2,173,909 | 9/1939 | Kritchevsky | 209/166 |
| 2,206,928 | 7/1940 | Ulrich | 260/404 |
| 2,278,107 | 3/1942 | Jayne | 209/166 |
| 2,290,411 | 7/1942 | De Groote | 260/404 X |
| 2,290,414 | 7/1942 | De Groote | 260/404 X |
| 2,312,414 | 3/1943 | Jayne | 209/166 |
| 2,389,763 | 11/1945 | Cahn | 209/166 |
| 2,574,407 | 11/1951 | Malkemus | 252/61 X |
| 2,710,856 | 6/1955 | Carpenter | 252/61 X |
| 3,179,250 | 4/1965 | Bunge | 209/166 |

*Primary Examiner*—Robert Halper

*Attorney, Agent, or Firm*—Michael L. Glenn

[57] ABSTRACT

In the beneficiation of phosphate ore by the flotation of siliceous material, a collector prepared by condensing a mixture of a fatty acid or ester, and ethanolamine and a hydroxyethylethylenediamine improves the separation of phosphate from silica.

5 Claims, No Drawings

FROTH FLOTATION PROCESS USING CONDENSATES OF HYDROXYETHYLETHYLENEDIAMINES AS COLLECTORS FOR SILICEOUS MATERIAL

BACKGROUND OF THE INVENTION

This invention relates to an improved process for phosphate beneficiation. In particular, this invention relates to the use of a condensate of a fatty acid or ester, an ethanolamine and a hydroxyethylethylenediamine as a collector for the flotation of siliceous matter from phosphate.

Typically, in the commercial beneficiation of siliceous phosphate ores, a deslimed and sized phosphate ore is conditioned with and then floated by a fatty acid collector and fuel oil reagent in an aerated aqueous solution at a pH of at least about 8. This flotation process produces a low-grade phosphate concentrate containing from about 50 to 65 weight percent bone phosphate of lime (BPL). The low-grade concentrate from the aforementioned flotation is blunged with acid to remove fatty acid collector coatings and the phosphate is further concentrated by flotation of residual silica from the concentrate with a so-called cationic amine collector.

U.S. Pat. No. 2,173,909 teaches the use of condensation products of alkanolamines and higher organic acids in a froth flotation process to float silica from phosphate. However, in the present commercial beneficiation of siliceous phosphate ores the reaction product of a polyalkylene polyamine and a fatty acid ester, as disclosed in U.S. Pat. No. 2,278,060, is generally employed as the cationic amine collector because of its relatively greater activity. These prior art cationic amine collectors are only moderately effective and selective. Furthermore, these collectors have become increasingly expensive in recent years.

U.S. Pat. No. 2,206,928 discloses the preparation of condensation products of hydroxyalkyl amines bearing at least two amino nitrogen atoms with higher organic acid substances. These products are disclosed to be useful as dispersing agents, wetting agents and the like. Nothing in this reference suggests that these condensation products are useful as flotation agents.

SUMMARY OF THE INVENTION

According to this invention, silica can be separated from phosphate ore in a froth flotation process comprising frothing the siliceous phosphate ore in the presence of an effective amount of a condensation product or an acid salt of a condensation product of a fatty acid or fatty acid ester condensed with (i) a compound represented by formula I

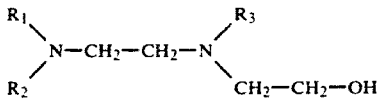

I wherein $R_1$-$R_3$ are each independently hydrogen or hydroxyethyl, or (ii) a mixture of a compound of formula I and an ethanolamine selected from the group consisting of monoethanolamine, diethanolamine and triethanolamine, said components of the condensation product having been condensed in a ratio of 1 equivalent of fatty acid or ester to from about 0.0 to about 0.7. equivalent of the alkanolamine and from about 0.3 to about 1.0 equivalent of the compound of formula I.

DETAILED DESCRIPTION OF THE INVENTION

Monoethanolamine, diethanolamine and triethanolamine are all well-known compounds, which are readily available commercially. The ethanolamine compound reacted with the fatty acid and hydroxyethylethylenediamine to prepare the condensation product can operably be a single compound, but it is frequently more economical to utilize a mixture of these ethanolamines. Monoethanolamine is the preferred ethanolamine.

The compounds represented by formula I are also well-known, readily available compounds. A mixture of these compounds containing a predominant amount of dihydroxyethylethylenediamine and trihydroxyethylenediamine isomers is preferred. Dihydroxyethylethylenediamine isomers are especially preferred.

The fatty acid condensed with the ethanolamine and hydroxyethylethylenediamine to produce the condensation product can operably be a saturated or unsaturated fatty acid. The fatty acids are a clearly defined class of organic carboxylic acids having from 4 to 22 carbon atoms, as is defined in *The Condensed Chemical Dictionary,* 9th Ed., p. 374, Van Nostrand Reinhold Co. (1977). The fatty acid can be selected from the group consisting of oleic, lauric, linoleic, palmitic, stearic, myristic, mixtures thereof and other like fatty acids. The esters corresponding to the fatty acids, such as glycerides, are operable, but less preferred. For reasons of economy, it is preferred to use crude mixtures of fatty acids derived from vegetable or animal sources containing rosin acids, lignin, and unsaponifiable matter, such as tall oil, coconut oil, palm oil, palm kernel oil, cottonseed oil, linseed oil, olive oil, peanut oil, fish oil and the like. Tall oil and tall oil heads are especially preferred mixtures of fatty acids and rosin acids. Tall oil and tall oil heads are well-known compositions described in the *Kirk-Othmer, Encyclopedia of Chemical Technology,* 2nd Ed., Vol. 19, pp. 614–629, Interscience (1969), which is incorporated herein by reference.

The fatty acid or its ester is readily condensed with the ethanolamine compound and the hydroxyethylethylenediamine compound by bringing these reactants together and heating the mixture until substantially complete condensation of the reactants is effected. The reaction is termed a condensation herein to distinguish it from the formation of the ammonium salt of the acid at lower temperatures. Generally, a reaction temperature of from about 130° C. to about 250° C. is operable to effect condensation. Although it is desirable that the condensation reaction is substantially complete, the condensate is effective as a collector even in the presence of a substantial amount of the ammonium salt of the acid.

The order in which the ethanolamine and the hydroxyethylethylenediamine compounds are condensed with the fatty acid is not critical. Therefore, one or the other of these reactants could first be condensed with the fatty acid and then the other reactant could be introduced and condensed. It is preferred that all of the reactants are first brought together with mixing and then are condensed. The condensation product can be readily recovered by distilling all of the water of condensation from the product. The progress of the condensation reaction can be monitored by the quantity of the water of condensation distilled from the reaction or by infrared spectrophotometric analysis.

The efficacy of the condensation product as a collector is greatest when the reactants are condensed in a specific range of mole ratios. Preferably, the sum of the equivalents of the ethanolamine compound and the compound of formula I condensed with the fatty acid or ester to prepare the condensation product is from about 0.9 to about 1.1 times the equivalents of fatty acid or ester condensed therein. More preferably, the ethanolamine and the compound of formula I are also employed in the condensate in substantially equimolar quantities.

The condensation product can operably be dispersed by mechanical means in the froth flotation medium and utilized directly. In one preferred embodiment the condensation product is first dissolved in fuel oil and then is dispersed. This condensation product can operably be pH neutralized with a mineral acid or carboxylic acid, such as formic, acetic, hydrochloric and like acids, and the resulting salt or partial salt can be employed as the collector. Acetic acid is especially preferred for this purpose.

The condensation product or its salt described hereinbefore can be used alone or in a mixture with other collectors. In particular, this collector can be used in conjunction with conventional diethylenetriamine/tall oil flotation agents to improve the selectivity and recovery of the collector system. This collector can likewise be used in conjunction with other adjuvants such as activators, conditioning reagents, dispersing reagents, frothing reagents and depressing reagents.

The practice of the method of this invention can be used alone to beneficiate siliceous phosphate ore after washing, desliming and sizing the ore. However, this collector is more preferably used to beneficiate the so-called "rougher float concentrate" obtained from flotation of the phosphate values in the ore with a fatty acid and subsequent removal of the residual fatty acid coating. Desirably, the phosphate is from the so-called Florida phosphate ore, which is typically substantially free of carbonate impurities after washing and sizing. Generally, a phosphate rougher concentrate in the size range from plus 200 mesh (U.S. Size) to minus 1 millimeter is amenable to beneficiation by the disclosed process.

The flotation collector, as hereinbefore described, can be used in the separation of siliceous matter from phosphate values in a manner like that known in the art for other cationic amine collectors. The flotation feed is deslimed and treated with mineral acid to remove residual fatty acid collector coatings. The collector and other flotation reagents are then introduced into an aqueous pulp of the phosphate feed at a density suitable for flotation. The feed can be briefly conditioned with the collector, or, less preferably, aerated without conditioning to float the siliceous matter. The concentrated phosphate rock is then recovered in the underflow.

The optimum loading of the fatty acid/ethanolamine/hydroxyethylethylenediamine condensate to produce best separation and greatest recovery of the phosphate values is influenced by the relative concentration of phosphate and insolubles (such as sand) in the flotation feed, the use of other collectors, the type of ore bodies, the loading of other flotation adjuvants (for example, fuel oil) and other factors. Generally, if the instant condensate is the only collector employed, a ratio of from about 0.05 to about 1 kilogram of condensate per ton of flotation feed is desirable. The use of the disclosed collector at the above-described loadings reduces or obviates the need for frothers, such as pine oil, in the flotation medium.

It is generally advantageous to employ fuel oil in the medium as an adjuvant to the collector. Representative fuel oils include diesel oil, kerosene, Bunker C fuel oil, mixtures thereof and the like. The fuel oil can operably be employed in any ratio less than about 1 kilogram of fuel oil per ton of flotation feed. Preferably, the fuel oil is present in a ratio of at least about 0.05 kilogram of fuel oil per ton of flotation feed.

The following examples are illustrative embodiments of this invention. Unless otherwise indicated all parts and percentages are by weight.

EXAMPLES 1-14

Comparative Experiments 1-2

In a series of identical flotation runs that differ only in the loading and identity of the collector employed, a 500 gram charge of phosphate rougher float concentrate washed with mineral acid and water is beneficiated by froth flotation. The rougher float concentrate is derived from phosphate ore mined near Fort Meade, Fla. The above-described concentrate is found by conventional methods of analysis to contain 61.9 percent bone phosphate of lime (BPL).

The feed is first diluted with water to obtain a slurry with a pulp density of about 20 percent solids. This slurry is transferred to a Denver flotation machine, where it is combined with a collector. The collector in the runs embodying this invention is prepared by reacting a mixture of hydroxyethylethylenediamines (HEED) with tall oil fatty acid (TOFA) and optionally triethanolamine (TEA) at 200° C. until the condensation is substantially complete (about 2.5 hours). Substantial completion of the reaction is determined by monitoring the water by-product from the reaction and by infrared spectrophotometric analysis of the condensed product. The composition of the tall oil fatty acid is 39 percent rosin acids, 29.3 percent oleic acid, 23 percent linoleic acid, 3.7 percent conjugated linoleic acid, 1.8 percent stearic acid and about 5 percent other fatty acids and components. The composition of the hydroxyethylethylenediamine mixture is about 6 percent aminoethylethanolamine, 80 percent dihydroxyethylethylenediamine, 15 percent trihydroxyethylethylenediamine and 4 percent tetrahydroxyethylethylenediamine. The mole ratio of HEED:TEA:TOFA is either 1:1:2, 7:3:10, 3:7:10 or 1:0:1 in the condensates embodying this invention. For a pair of comparative experiments, a condensate is prepared in a mole ratio of 0:1:1. In some of the flotation runs these condensates are employed directly. In the remainder of the runs, these condensates are neutralized with acetic acid to a pH of 7 and are utilized in the form of partial acetate salts.

The above-identified collectors are introduced into the flotation slurry in 0.15 or 0.2 gram charges. An amount of #2 fuel oil equal in weight to the charge of collector is also introduced into the slurry. The phosphate rougher float concentrate is briefly conditioned with the collector and fuel oil by high speed agitation of the medium. Flotation is promoted by aeration with mixing for two to three minutes and the floating concentrate is concurrently collected.

The collected concentrate and the tail material are individually dewatered with a 150 mesh (U.S. Size)

screen and then dried. Both the concentrate and tail fractions are analyzed for percent BPL by standard photometric methods.

In Table I are tabulated the mole ratio of the components condensed in the collector, the loading of the collector in kilograms per metric ton of phosphate feed, whether or not the collector is a partial acetate salt, and the BPL assay of the tail and concentrate. The distribution of phosphate in the tail is tabulated as a percentage of the total phosphate present in the tail and concentrate to provide an index to the degree of recovery effected.

TABLE I

| Example | Ratio (HEED:TEA:TOFA) | Loading (kg/ton) | Acetate Salt | Tail (% BPL) | Concentrate (% BPL) | Phosphate Recovery in Tail (%) |
|---|---|---|---|---|---|---|
| 1 | 1:1:2 | 0.3 | yes | 72.51 | 13.10 | 94.54 |
| 2 | " | 0.4 | yes | 71.94 | 18.38 | 91.68 |
| 3 | " | 0.3 | no | 75.74 | 13.16 | 94.57 |
| 4 | " | 0.4 | no | 72.73 | 18.72 | 90.86 |
| 5 | 7:3:10 | 0.3 | yes | 69.75 | 12.64 | 95.44 |
| 6 | " | 0.4 | yes | 71.07 | 13.40 | 94.48 |
| 7 | " | 0.3 | no | 71.83 | 13.51 | 94.61 |
| 8 | " | 0.4 | no | 70.79 | 23.44 | 89.27 |
| 9 | 3:7:10 | 0.3 | yes | 66.67 | 10.53 | 97.32 |
| 10 | " | 0.4 | yes | 69.78 | 12.05 | 95.70 |
| 11 | 1:0:1 | 0.3 | yes | 64.62 | 12.19 | 94.73 |
| 12 | " | 0.4 | yes | 63.36 | 13.77 | 93.27 |
| 13 | " | 0.3 | no | 68.63 | 13.20 | 95.45 |
| 14 | " | 0.4 | no | 71.42 | 13.44 | 94.38 |
| Comparative Experiments* | | | | | | |
| 1 | 0:1:1 | 0.3 | no | 65.31 | 8.42 | 98.93 |
| 2 | " | 0.4 | no | 65.69 | 16.09 | 96.19 |

*Not an embodiment of this invention.

EXAMPLES 15–18

Four flotations are performed in the manner of Examples 1–4, except that the tall oil fatty acid component of the condensation product contains a fatty acid fraction (70 percent of this component) consisting of 54 percent palmitic acid, 20.3 percent oleic acid, 12.6 percent linoleic acid, 1 percent rosin acid and 12 percent other fatty acids. This tall oil fatty acid also contains an unsaponifiable fraction of about 30 percent by weight. The ratio of HEED:TEA:TOFA in this condensate is 1:1:2. The relevant flotation parameters and results are tabulated in Table II.

TABLE II

| Ex. | Loading (kg/ton) | Acetate Salt | Tail (% BPL) | Concentrate (% BPL) | Phosphate Recovery in Tail (%) |
|---|---|---|---|---|---|
| 15 | 0.3 | yes | 73.65 | 11.77 | 96.27 |
| 16 | 0.4 | yes | 73.31 | 12.76 | 95.75 |
| 17 | 0.3 | no | 71.26 | 12.66 | 96.21 |
| 18 | 0.4 | no | 74.00 | 13.31 | 95.41 |

EXAMPLES 19–20

A pair of flotations are performed in the manner of Examples 1 and 2, except that diethanolamine (DEA) is employed as the ethanolamine component in the condensation product. The collector is a partial acetate salt of the condensate having a component mole ratio (HEED:DEA:TOFA) of 1:1:2. The relevant flotation parameters and results are tabulated in Table III.

TABLE III

| Ex. | Loading (kg/ton) | Tail (% BPL) | Concentrate (% BPL) | Phosphate Recovery in Tail (%) |
|---|---|---|---|---|
| 19 | 0.3 | 71.14 | 10.84 | 96.92 |
| 20 | 0.4 | 74.52 | 20.28 | 92.17 |
| 21 | 0.3 | 73.19 | 11.84 | 96.04 |
| 22 | 0.4 | 74.40 | 21.21 | 90.71 |

EXAMPLES 21–22

A pair of flotations are performed in the manner of Examples 1 and 2, except that monoethanolamine (MEA) is employed as the ethanolamine component in the condensation product. The collector is a partial acetate salt of the condensate having a component mole ratio (HEED:MEA:TOFA) of 1:1:2. The relevant flotation parameters and results are tabulated in Table III.

What is claimed is:

1. In a froth flotation process for floating siliceous matter from phosphate ore, the improvement comprising frothing the siliceous phosphate ore in the presence of a condensation product or an acid salt of a condensation product of a fatty acid or fatty acid ester condensed with (i) a compound or mixture of compounds of formula I

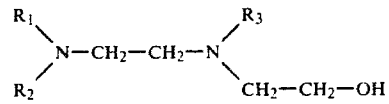

I wherein $R_1$–$R_3$ are each independently hydrogen or hydroxyethyl, with the proviso that a predominant amount of the compounds of formula I bear two or three hydroxyethyl moieties, and (ii) an ethanolamine selected from the group consisting of monoethanolamine, diethanolamine and triethanolamine, said components of the condensation product having been condensed in a ratio of from about 0.3 to about 0.7 equivalent of (i) for each equivalent of fatty acid or ester and the sum of the equivalents of components (i) and (ii) in the condensation product being from about 0.9 to about 1.1 times the equivalents of fatty acid or ester, said condensation product or a salt thereof being present in the flotation medium at a loading which is not substantially greater than the loading which effects the maximum assay of phosphate in the underflow.

2. The process as described in claim 1 wherein fuel oil is present during flotation as an adjuvant to the collector.

3. The process as described in claim 2 wherein the condensate is present in the form of its partial acetate salt.

4. The process as described in claim 3 wherein the fatty acid or fatty acid ester is a tall oil fatty acid, tall oil heads, a tall oil fatty acid ester or a mixture thereof.

5. The process as described in claim 1 wherein the fatty acid or ester is condensed with substantially equimolar quantities of the ethanolamine and the compound of formula I.

* * * * *